US006330923B1

(12) United States Patent
Wood

(10) Patent No.: US 6,330,923 B1
(45) Date of Patent: Dec. 18, 2001

(54) SEALING BEARINGS IN DRILL BITS

(76) Inventor: Roy W. Wood, 419 Persimmon St., Birmingham, AL (US) 35214

( * ) Notice: Subject to any disclaimer, the term of this patent is extended or adjusted under 35 U.S.C. 154(b) by 0 days.

(21) Appl. No.: 09/345,831

(22) Filed: Jul. 1, 1999

(51) Int. Cl.[7] ..... E21B 10/08
(52) U.S. Cl. ..... 175/371; 277/550; 384/94
(58) Field of Search ..... 175/371, 372; 277/335, 550, 551, 572, 574, 437, 439; 384/94

(56) References Cited

U.S. PATENT DOCUMENTS 3,529,840 * 9/1970 Durham et al. ..... 277/383
4,252,330 * 2/1981 Crow ..... 175/371
4,304,444 * 12/1981 Persson ..... 384/93
4,429,854 * 2/1984 Kar et al. ..... 384/94
4,516,641 * 5/1985 Burr ..... 175/372

* cited by examiner

*Primary Examiner*—William Neuder
(74) *Attorney, Agent, or Firm*—John K. Donaghy

(57) ABSTRACT

A sealed bearing for a drill bit including cutting cones and having metal sealing surfaces between the seal cup base and the rotating cone combined with a compressible neoprene or like material having an inner seal lip to seal in the prepacked bearing cavity and an outer seal lip nestled in a recess in the bearing skirt to protect it to keep out foreign matter.

5 Claims, 1 Drawing Sheet

FIG. 1
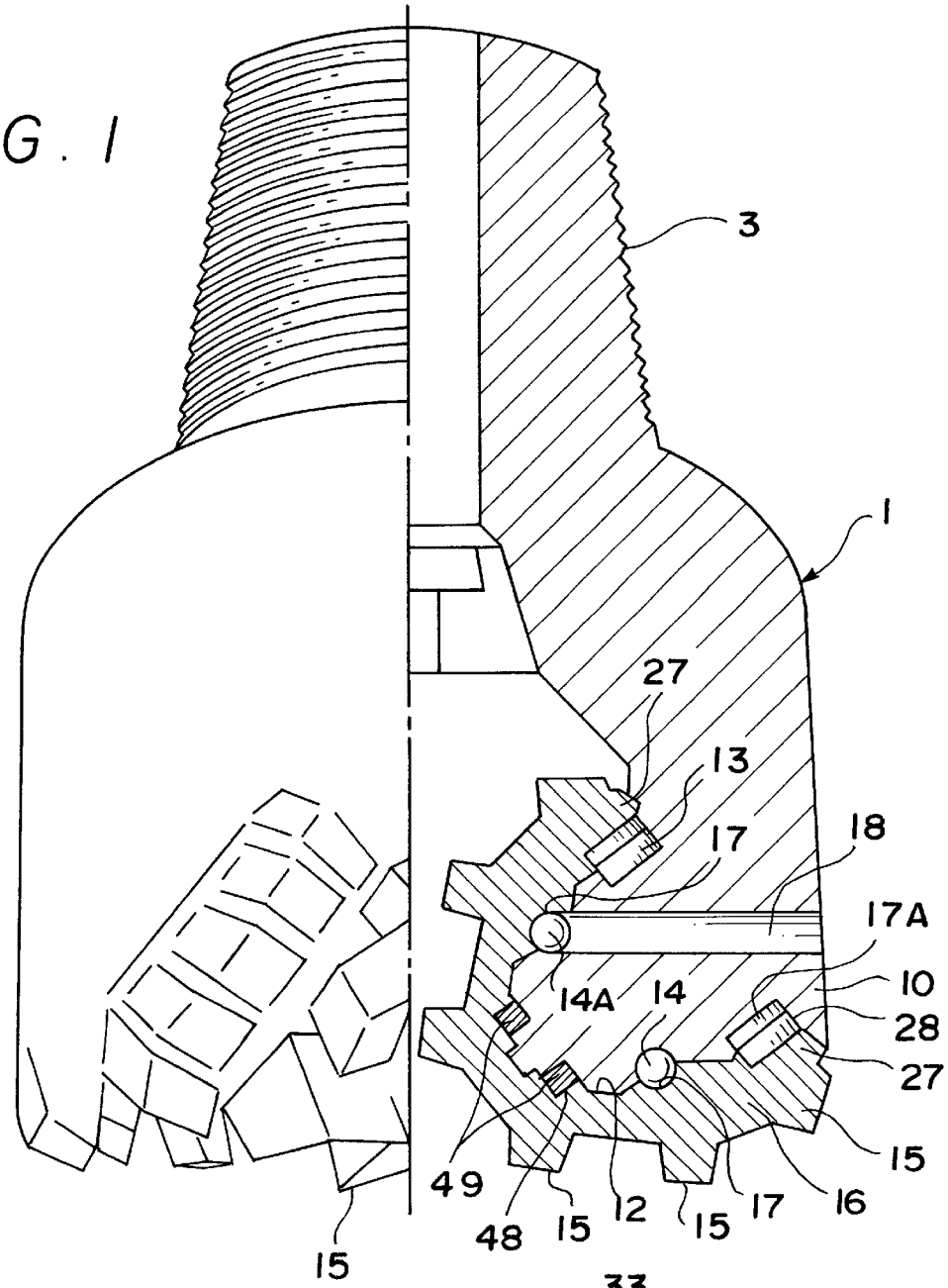
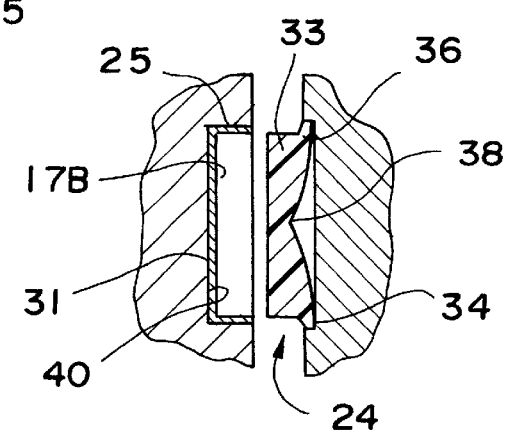
FIG. 2

SEALING BEARINGS IN DRILL BITS

BACKGROUND OF THE INVENTION

1. Field of the Invention

This invention pertains to sealing ball, roller bearings in rotary rock bit cuttings cones but more particularly rotary rock bits used in mining and construction blast holes using air as the medium for purging the base hole of cuttings.

2. Background of Prior Art

The prior art discloses various attempts at effecting a seal for this application using neoprene "O" rings and neoprene covered metal but have been in effective due to the extreme heat generated by friction of the seal itself and bearings from loading and RPM speed and heated air from compression. Air is not sufficient to dispel this generated heat to allow the prior art seals to function properly.

SUMMARY OF THE INVENTION

There is a need in mining drills for a seal that can function properly to offer prelubricated bearings to afford higher RPMs and heavier down pressures to maximize production of the drill and reduce cost per foot expenditures and to minimize costly downtime consumed in changing bits.

An object of this invention comprehends or otherwise considers the various heat generating sources and the proposes herein to reduce them to a level that allows the seal to function within its heat range. And another object of this invention is to provide a seal that reduces the friction heat generated by the bearings and heat generated by the seal itself.

Yet another object of this invention is to provide a drill bit having factory packed lubrication fillings in the bearing cavity to dispel or dissipate friction heat.

Still a further purpose of this invention is to provide a composite seal having a cup seal base with a prelubricated smooth surface.

And a further object of this invention is to provide a neoprene or similar material having an inner and outer lip with a recess in the center.

A further object of this invention is to provide a seal comprising a cup member having a smooth outer sealing surface and a neoprene or similar material bonded to it comprising an inner and outer lip with a center recess for compressing the lips.

A further purpose of this invention is to provide a seal having a smooth prelubricated sealing surface that mates to a smooth fitting recessed surface in the rotating cutting cone.

A further purpose of this invention is to provide a seal having a neoprene or like material bonded to the seal cup member having an inner lip that seals the lubricant in the bearing cavity and an outer lip that seals out foreign matter and a recess in the middle to allow compression of the inner and outer seal lips.

A further purpose of this invention is to have a recess in the bearing skirt corresponding to the outer lip seal to protect it from erosion.

It is another object of this invention to effectively prelubricate mining bit cone bearings to allow drill rigs to operate at their optimum RPM and down pressure.

And yet another object of this invention to get maximum bit life attainable through this technology.

It is an important object of this invention to obtain maximum production and operation life from the drill rigs thus reducing the high cost of repairs. Other attempts in this art have failed due to the high temperature and pressure generated in rock drilling bit.

This invention is a long awaited seal which will extend bit useful life under such high temperatures and compression.

I further claim that a seal having an inner lip and an outer lip being recessed in the middle effects a flexible action when compressed to cause said inner and outer lips to allow for variance during operation between the sealed surfaces and yet maintain its sealing capacity.

I further claim that a sealing surface having a recess in the sealed surface protects the flexible seal lip from abrasive material such as is present in bore hole conditions.

I further claim that this invention will greatly enhance drill performances and extend useful bit life for the mining industry.

BRIEF DESCRIPTION OF THE DRAWINGS

FIG. 1 depicts a cut away side view of one cutting cone with bearings, a seal, bearing trunion, bearing skirt, retaining ball access hole and the threaded portion of the drill bit. As is well known in this art, the threaded portion is attached to a drill string.

FIG. 2 is an exploded view of the bearing skirt with seal recess, cutting cone and seal recess, seal cup with smooth sealing surface corresponding to the smooth cone recess and neoprene or like material seal having an inner and outer seal lip and a center recess for compression.

DETAILED DESCRIPTION OF THE PREFERRED EMBODIMENT OF THE INVENTION

Now to more specific details of the drawings of this invention. FIG. 1 presents a cut away view of one section of a rotary rock drill bit 1 used in air blast mining. Each section consists of a threaded portion 3 for attaching to a drill string (not shown), and skirt 10 member. The skit member 10 has a machined trunion 12 to receive a series of cutting cones 15 machined on a base 16. The cutting cones 15 have bearings 14 and 14A positioned in recess bearing cavities 17, FIG. 1.

The bearings 14 and 14A separates the cutting cones 15 bunion areas 12 on skirt 10. The bearing 14 and 14A rests in the cutting cone cavities 17. A recess or cavity 17B in the cutting cone 15 is provided for receiving a seal unit member 24, FIG. 2. The various ball bearings 13, 14 and 14A are inserted through the access hole 18 as the base 16 is rotated on the skirt 10.

FIG. 2 shows an exploded cross section view of the seal unit 24 comprising a cup member 25 or other like material and is compressible member 33. The cup 25 has a smooth outer surface 31 which mates with the cutting cone recess or cavity 17B, FIG. 1. The smooth outer surface 31 of cup 25 and the smooth inner surface 40 of cavity 17B provides an effective metal to metal surfaces, FIG. 2, are prelubricated and provide effective sealing surfaces on the rotating surface of the cutting cone 15, FIG. 1. The sealing member 33, FIG. 2, has an inner lip 36, and an outer lip 34 spaced by a center recess 38. This construction permits or facilities for compression of the seal member 33 in the skirt 10 recess 27 and 28 to protect the outer seal lip 34. Said seal cup portion 25, FIG. 2, may be bonded to seal member 24 or other like compressible material having similar properties to form an effective seal unit.

A series of members 49 in lubricated recesses 48, FIG. 1, are carbonized thrust loading areas for the cutting cones 15.

While the invention has been described with regard to a preferred embodiment of the invention, it will be evident to those skilled in this art that numerous changes may be made to this invention without departing from the spirit and scope thereof.

What I claim is:

1. A sealed bearing for a drill bit having a threaded portion and a skirt member, comprising:

a trunion portion on said skirt member;

a recession in said skirt member;

a cutting cone on said trunion portion;

at least one bearing member between said trunion member and said cutting cone;

a smooth recess cavity in said cutting cone;

a cup member having a smooth outer surface abutting the smooth recess cavity;

compressible material in the cup member having an outer lip and an inner lip; and said inner lip and said outer lip mating with the recess in the skirt member thereby effecting a seal between the skirt member and the cutting cone.

2. A sealed bearing according to claim 1 whereby said outer lip and said inner lip are separated by a center recess; and whereby said compressible material of said cup member is compressed into the recess in the skirt member.

3. A bearing seal according to claim 2, whereby said lips are compressible in the recess in the skirt member.

4. A sealed bearing according to claim 2, whereby said inner lip seals lubrication in the bearing cavity; and said outer lip seals out foreign matter.

5. A sealed bearing according to claim 1, whereby said smooth surfaces of said cup member and said smooth recess cavity are prelubricated whereby friction heat is minimized.

* * * * *